US006386824B1

(12) United States Patent
Pizzi et al.

(10) Patent No.: US 6,386,824 B1
(45) Date of Patent: May 14, 2002

(54) APPARATUS FOR PROCESSING LAYERS SUCH AS STACK LAYERS OF PAPER

(75) Inventors: Fausto Pizzi; Gilberto Forni, both of S. Giovanni in Persiceto (IT)

(73) Assignee: Bielomatik Leuze GmbH & Co. (DE)

( * ) Notice: Subject to any disclaimer, the term of this patent is extended or adjusted under 35 U.S.C. 154(b) by 0 days.

(21) Appl. No.: 09/721,799

(22) Filed: Nov. 24, 2000

Related U.S. Application Data

(63) Continuation of application No. 09/131,057, filed on Aug. 6, 1998, now abandoned.

(30) Foreign Application Priority Data

Aug. 13, 1997 (DE) ..... 197 34 994

(51) Int. Cl.[7] ..... B65G 57/10

(52) U.S. Cl. ..... 414/793.4; 414/789.1; 414/907

(58) Field of Search ..... 414/788.9, 789, 414/789.1, 791.6, 793.4, 907

(56) References Cited

U.S. PATENT DOCUMENTS 3,918,598 A 11/1975 VanderMeet ..... 414/791.6 X
4,195,959 A * 4/1980 Schmitt ..... 414/788.9
4,477,218 A 10/1984 Bean
4,927,321 A 5/1990 Lucas ..... 414/788.9

FOREIGN PATENT DOCUMENTS

| | | |
|---|---|---|
| DE | 30 33 793 | 3/1982 |
| DE | 34 12 183 | 1/1985 |
| DE | 41 01 038 | 7/1992 |
| EP | 0 852 989 | 7/1998 |

* cited by examiner

*Primary Examiner*—Janice L. Krizek
(74) *Attorney, Agent, or Firm*—Akerman Senterfitt

(57) ABSTRACT

On a lifter table (23) a pallet (2) is first deposited in a lower position and then following lifting of this table (23) the pallet (2) is precisely aligned by suitable apparatus (40). Thereafter reams of paper are deposited on the pallet (2) by a conveyor (50) and the topmost reams in each case precisely aligned relative to the pallet (2) by the same apparatus (40) in each case such that their edge faces are located set back relative to those of the pallet (2). Thereby precisely congruent stacks are achieved in fast operation.

21 Claims, 3 Drawing Sheets

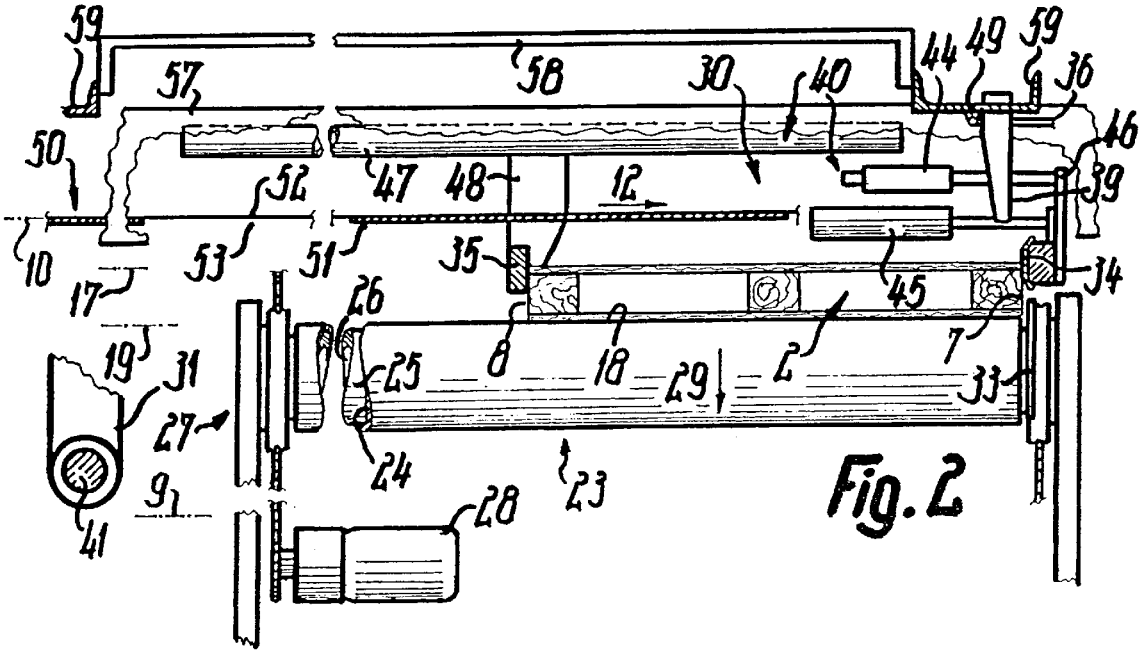
Fig. 2
Fig. 3
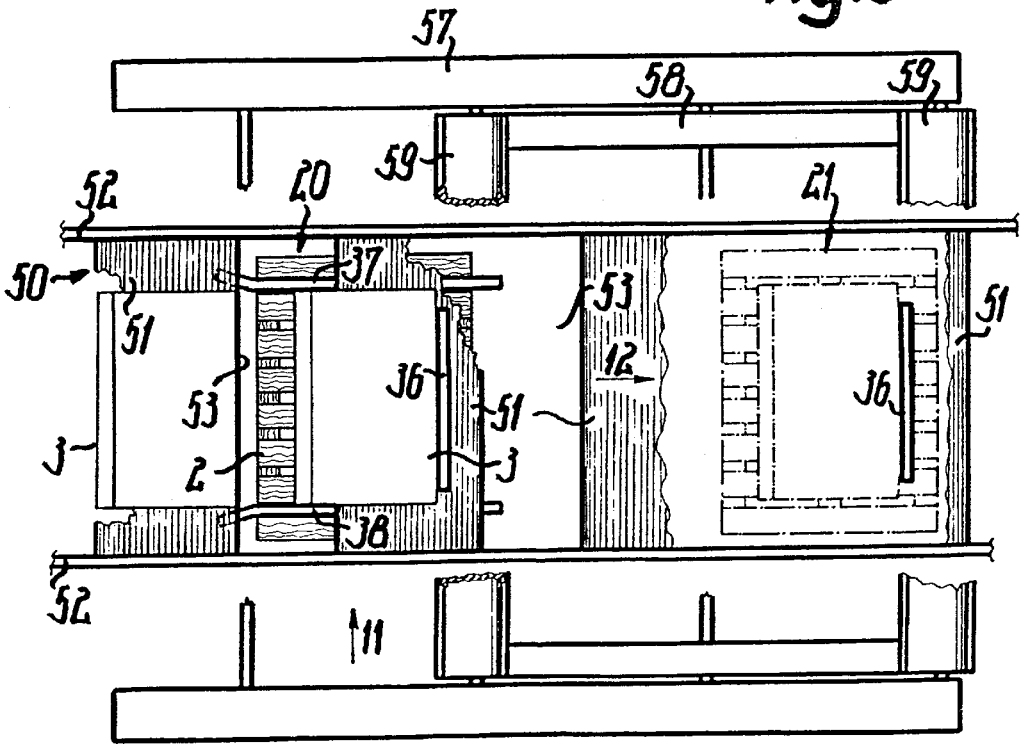

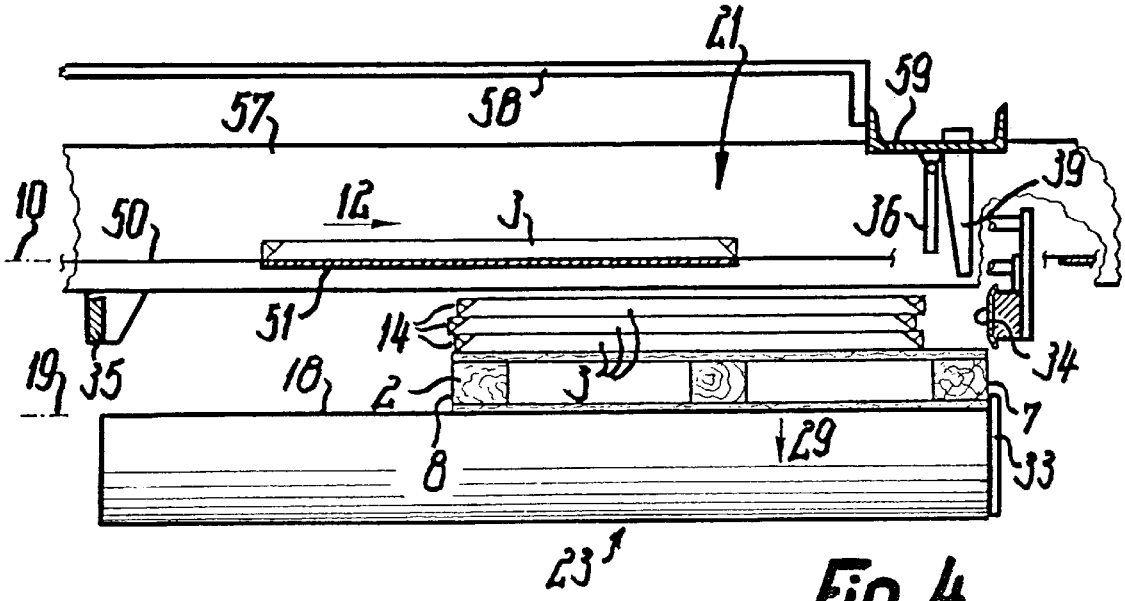
Fig. 4
Fig. 5
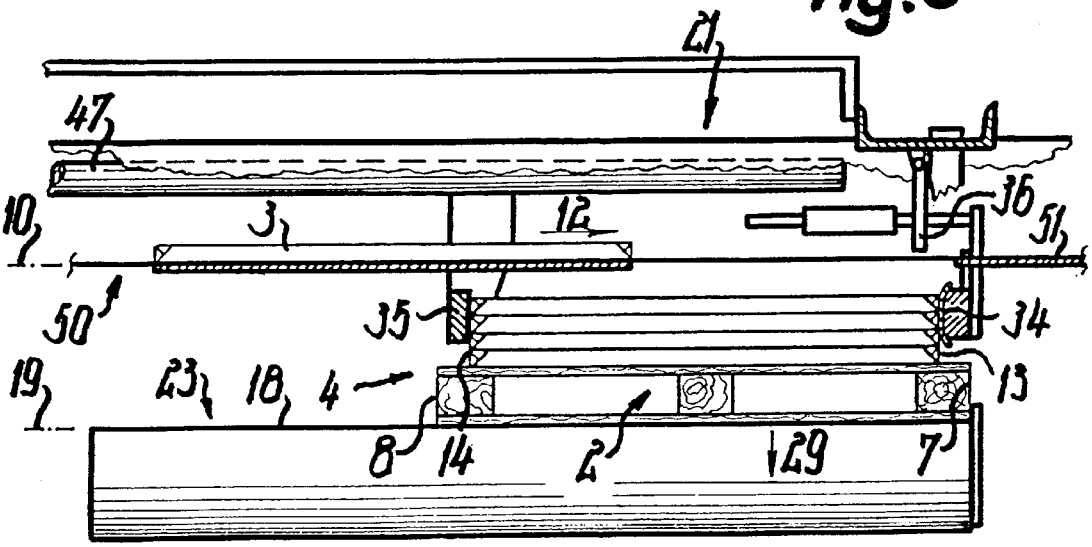

APPARATUS FOR PROCESSING LAYERS SUCH AS STACK LAYERS OF PAPER

CROSS REFERENCE TO RELATED APPLICATIONS

This application is a continuation of U.S. application Ser. No. 09/131,057 filed on Aug. 6, 1998, now abandoned.

TECHNICAL FIELD AND BACKGROUND OF THE INVENTION

The invention relates to an apparatus or method for processing, more particularly for collating, sheet or flat material into packs, such as cubic piles or stacks. The layers then form in the stack flat faces throughout on all sides and adjoin each other in an inclined direction or vertically. Provided in the pile may be differingly sized layers of material. A larger or first layer is a support layer, such as a pallet, and smaller or second layers are individual sheets of paper or the like. The latter are collated in common with a wrapping or the like to form a substack, such as a ream of paper. All edge faces of each stack layer are set back relative to all corresponding edge faces parallel thereto of the support layer in the pile. So they are protected from impact during shipping by the protruding support layer—termed pallet in the following.

Precisely aligning the layers, namely the pallet and the stack layers—termed reams in the following—relative to each other is difficult when they need to be collated at high speed before being delivered as unit sets. If the layers are simply aligned be being moved on a conveyor against a stop they may assume positions rotated out of place relative to each other, namely skew instead of in line relative to each other. If the stack layers are shifted relative to each other on completion of piling, damage may occur due to the layers resting on each other under a high face pressure or under the weight superposed.

OBJECTS OF THE INVENTION

An object is to provide an apparatus or a method which avoids the disadvantages of known configurations or as described. Another object is to ensure a precise alignment of the layers after placement on a table top or on the stack or the like. A still further object is to permit fully automatic collation or stacking of the layers.

SUMMARY OF THE INVENTION

According to the invention means are provided for primarily depositing layers, pallet and/or reams, on a table top and for subsequently aligning a predetermined number of stack layers parallel to the table top, this number being any between one and three or five. Alignment is achieved in first and second directions parallel to the table top, the second direction being oriented at right angles to the first direction. In the case of rectangularly bounded layers each of the directions is located at right angles as well as parallel to the edge faces of these layers. The means firstly align the pallet slidingly on the table top. Thereafter several reams are placed on the pallet and on each other before then being aligned in common on the pallet as well as on each other slidingly. Thereby all edge faces associated with each other of these reams are located in the same plane as well as set back relative to the corresponding edge faces of the pallet by the same distances. For instance, the center axes at right angles to the planes of all layers may be coaxial in the finished or finally aligned condition. It is an advantage to initially deposit the ream offset from its final alignment, by prealigning it to one side before then shifting it into final alignment.

As aligning members the same stops or pushers may be used both for aligning the pallet and subsequently for aligning the reams. For prealignment it is of advantage to provide a separate stop, such as a motion stop respective a separate pusher, such as a conveyor. The latter transports the reams from a zone remote from the stacking zone above the stack, aligning them thereby, before transferring them in this prealigned condition to the table. The aligning stops may be moved in a gripper action towards each other as well as towards the edge faces of the layers, more particularly exclusively linearly or parallel to the table plane. In this arrangement one of the two stops in each case may be positively locked in its stopping position by another stop to ensure precise positioning with speedy adjustment.

Instead of being desposited on a pallet the reams may also be directly placed on the table top, enabling nonpalletized piles to be formed. The stack layers can be then positionally interlocked by a common wrapping, for example, a full covering packaging of paper, carton or the like. The piling table provides a lift so that it can be lowered during piling by the thickness of each layer to ensure that the same transfer conditions exist for each such layer. Although the stops could be mounted on the piling table and adjustable relative thereto transversely to the table plane namely height-adjustable, they are preferably positioned in stationary fixtures or mounts of the stationary base frame of the apparatus. Thereby their spacing from the table plane changes with the height-adjustment of the stacking table. Accordingly, the stops can always be located to be effective in the region of the topmost layers whilst no longer being able to come into contact with the layers already aligned therebelow.

It is of advantage to feed the pallet to the piling table in one direction, for example in the cited second direction, whilst the reams are fed in a direction oriented at right angles, for example, in the cited first direction. Thereby an intersecting feed is achieved when seen in plan view on the table plane. At the stationary point of intersection stacking and alignment of all first and second layers accurs, after which the stack is removed co-directional with the prior feeding of the pallet.

Feeding and aligning of each of the layers may be implemented in accordance with European Patent Application 97121516.5 (date of application: Dec. 6, 1997), reference being made to the features and affects thereof for incorporating them into the present invention.

BRIEF DESCRIPTION OF THE DRAWINGS

Example embodiments of the invention are explained in more detail in the following and illustrated in the drawings in which:

FIG. 2 is a partial enlarged cross-section of FIG. 1

FIG. 3 is a section of FIG. 1, illustrating further details,

FIG. 4 is the section according FIG. 2 illustrating the reams already prealigned and piled, and FIG. 5 is the section according FIGS. 2 and 4 illustrating the reams finally aligned.

DETAILED DESCRIPTION

Figure 1:
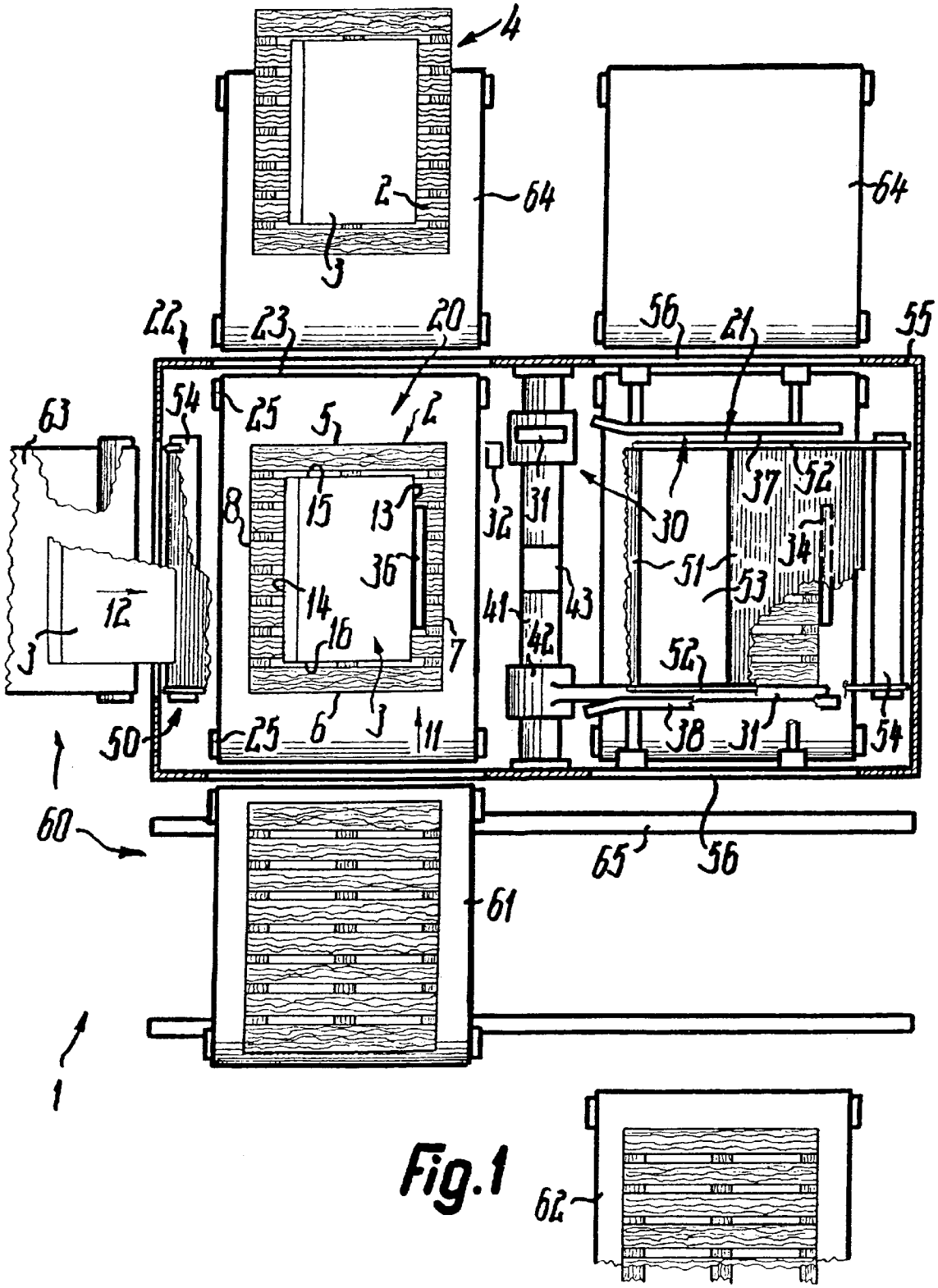
FIG. 1 is top view of the apparatus according to the invention

The apparatus 1 serves to stack reams 3 with or without a pallet 2 into a total stack 4 of all first and second layers 2, 3. The lowest supporting ply, namely pallet 2, is larger than reams 3 so that in plan view all of its edge faces 5 to 8 parallel and at right angles to each other protrude beyond all edge faces 13 to 16 of the reams 3. Edge faces 13 to 16 likewise parallel and at right angles to each other are then located parallel to the associated nearest edge face 5 to 8 in each case as well as being set back relative thereto. In the completed stack edge faces 13 to 16 of all reams 3 are located in a common plane at right angles to the conveying planes 9, 10 and to the material plane 17 of the layers 2, 3. Pallets 2 are supplied in a more remote, lower conveying plane 9 in conveying direction 11. Reams 2 are supplied in a nearer or higher conveying plane 10 in conveying direction 12 oriented at right angles to direction 11 in plan view on horizontal planes 9, 10. Stacks 4 are discharged in conveying plane 9.

Only after each layer 2, 3 was fed to a table top 18 and on or after completion of the corresponding conveying motion and prior to laying on the next layer 3 each layer 2, 3 is precisely aligned in directions 11, 12 relative to then stationary table top 18. Table top 18 defines a table plane 19 oriented parallel to planes 9, 10, 17 or directions 11, 12 and linearly moveable or elevatable from its position coplaner with plane 9 toward plane 10 before then being again incrementally returned or lowered. Alignment is done in a stacking station 20 or 21. Station 20 is located, with respect to direction 12, upstream and station 21 directly adjacent downstream of station 20. Both stations 20, 21 are configured substantially the same. Both stations 20, 21 receive pallets 2 in or counter to direction 11 before receiving reams 3 in or counter to direction 12. This is followed by the cited alignment relative to stationary a base frame 22 of apparatus 1.

It is not until after the above functions that the next ream 3 is placed on the partial stack in each case or lowered or deposited continuously bit by bit with a shallow S-shaped curvature without the corresponding layer 2 or 3 again being moved before or after its alignment. The alignment motions are significantly smaller than the lenghts of the individual edge faces 5 to 8 and 13 to 16 or than half or a thenth thereof.

Table top 18 is formed by the upper side of a lift or layer table 23, namely by the upper plate or run of a conveyor belt 24 running around two pulleys 25 and back below the upper run parallel thereto. Between the pulleys 25 tensioning the upper run, the latter is rigidly supported against sagging, for example on a slide table, so that it passes planar throuhgout between the pulleys 25. Table top 18 or layers 2, 3 deposited thereon are movable in or counter direction 11 by a conveyor drive 26 located within a pulley 25 as an axle motor. Each of the table tops 18 or conveyor belts 24 of tables 23 are configured and mounted the same. They can be driven parallel to direction 12 and raised or lowered independently of each other.

Pulleys 25 can be mounted in a frame which in turn can be motordriven up and down in a table guide 27 secured to frame 22 or stationary by a lifting drive 28 in and opposite to lifting direction 29 oriented at right angles to planes 9, 10, 17, 19 and directions 11, 12. The maximum lifting height equals at least the maximum height of stack 4 or exceeds this height. Each table 23 of the only two stations 20, 21 can be powered up and down irrespective of the table 23 of the other station.

Provided within each station 20 or 21 are alignment means 30 operating independently of those of the other station. With them first pallet 2 is aligned by sliding on table top 18 in directions 11, 12 as long as table plane 19 is in or above plane 9 and below plane 10. After this, a first ream 3 is placed off-centered on pallet 2, on which then at least one further ream can be placed in sequence while being lowered from plane 10 as shown in FIG. 4. Before or during depositing the individual next ream 3 table 23 is lowered by the thickness or height of the preceding ream 3. Each ream 3 consists of a plurality of single layer paper sheets equal in size, stacked flush and wrapped by a folded packaging to thus form like pallet 2 a flat plate body which is dimensionally stiff against all pressures exerted in apparatus 1 transverse to plane 17. Ream 3 is bendingly flexible under the forces of its own weight when aligned horizontal.

After one to three first reams 3 have been prealigned and individually deposited off-center relative to each other as well as relative to pallet 2, these reams 3 are aligned in the final nominal position by means 30 in a single operation in common relative to each other and relative to the finally aligned pallet 2. Reams 3 thereby slide on pallet 2 and on each other up to abutted positions whilst pallet 2 remains unmoved simply by its friction contact with table top 18 or by being positively abutted. After this, a further ream 3 is deposited off-center and directly thereafter, as evident from FIG. 5, it is aligned by means 30 in a sliding motion on the already aligned reams 3 to have all edge faces 13 to 16 commonly flash and finally aligned. Aligning the pallet 2 as well as all reams 3 parallel to direction 12 is done with the same alignment members. Thereby all layers 2, 3 are shifted only in one direction 12 relative to table top 18.

Means 30 comprise members 31 to 39, each of which may be a stop, a sensor, such as a non-contacting proximity sensor, a pusher or the like. Aligning pallet 2 in direction 11 may be done in plane 9 by conveyor 24 moving the leading pallet edge 5 against a stop 31 and then halted. This may be activated by a sensor 32 sensing pallet 2 or one of edges 5, 6. Sensor 32 is located out of the way of the lifting path of table 23 adjacent to a side edge of the latter or between table lifts 23. Sensor 32 is stationary but adjustable like stop 31 parallel to direction 11 in varying positions and may be a photocell. Once edge 5 is fully in contact with stop 31 the latter is moved from edge 5 and out of the lifting path of table 23 upwards to one side.

Table 23 is then elevated to its highest level directly below plane 10. Thereafter alignment is made parallel to direction 12 should this not already have been done in plane 9.

For aligning pallet 2 in direction 12 namely a side stop 33 protruding beyond plane 19 may be provided on table 23 for one of edges 7, 8 located parallel to direction 11. If stop 33 is instead of not movable parallel to direction 12, a pusher or an inclined sliding face may be located opposite thereto which causes pallet 2 to come into contact with stop 33 after or during motion towards alignment members 31, 32 and thus aligning it parallel to direction 12. Relative to direction 12 downstream edge 7 is caused to come into contact with stop 33 whilst the pusher or the like could engage edge 8 facing away from the latter. Stop 33 does not execute the motion of table top 18, it instead being secured to the bearing frame of table 23 so that it participates with the lifting motions thereof. Stop 33 protrudes beyond table plane 18, 19 by less than the thickness of pallet 2 and positionally secures pallet 2 during alignment of reams 3. The same alignment members 31 or 32 may be used for alignment in both station 20 and station 21, more particularly alternately. It is also possible to use stop 31 or an opposite stop 31 for edge 6 as the powered pusher for aligning pallet 2 parallel to direction 11.

In the case illustrated pallet 2 is firstly prealigned in plane 9 at stop 33 before then being raised nearer under plane 10 where it is finally aligned by a pusher 35 in direction 12 against a counterstop 34. In this arrangement stop 34 located totally above plane 19 may be located with its stop face in the same plane as the stop face of stop 33 and like the pusher face of pusher 35 may or may not protrude upwards beyond the top of pallet 2 by the thickness of one to three reams 3. In this elevated level too, aligning pallet 2 parallel to direction 11 may be done with corresponding stops or pushers 37, 38.

Before reams 3 are deposited on table 23, pallet 2 and the reams 3 already lodated thereon, each ream 3 is prealigned in direction 12 and in plane 10 at a stop 36 such that thereafter it needs to be shifted in direction 12 only to be fully or finally aligned. Stop 36 protrudes upwards beyond plane 10 and like alignment members 34, 35 it is mounted overhead or suspended so that no parts protruding downwards beyond the stop or pusher face are provided. Alignment members 34, 35, 36 are permanently located spacedly above table plane 19. When reams 3 are conveyed in direction 12 over table 23 and pallet 2 the individual ream comes into contact by its downstream edge 13 with stop 36 resulting in its conveying motion being ended. After this, ream 3 thus prealingned is deposited on table 23 by a parallel shift in direction 29. Thereby alignment members 34, 35 may then be remote from layers 2, 3 or in contact therewith. Stop 36 of station 20 is to be moved out of the travel path of reams 3 or of plane 10 as shown in FIG. 2. Thus reams 3 can be transferred without any obstruction also up to station 21.

After alignment of pallet 2 and lowering thereof below members 34, 35 these same members 34, 35 are also used to align each of the reams 2 parallel to direction 12. Thus after or on lowering of pallet 2 alignment member 34 is moved counter direction 12 against a stationary stop 39 into the aligning position for reams 3. Reams 3 are then brought into contact by their downstream edges 13 with stop 34 by pusher 35 contacting upstream edge 14.

Each alignment member 31 to 39 can be motor-driven independently of the other, more particularly transverse to the associated edge face 5 to 8 and 13 to 16 or transverse to the edges therof or parallel to the associated edge face. For this purpose bearing or drive means 40 are provided and comprise elements 41 to 49.

A guide 41 is provided laterally adjacent to and between tables 23. Guide 41 is oriented parallel to direction 11 to bear one or two runners 42, each being fixedly connected to a stop 31. Guide 41 and its axis are located slightly above plane 9, 19 and are stationary relative to frame 22. In guide 41 also sensor 22 may be mounted to be continuously adjustable parallel to direction 11. Runner 42 and stop 31 can be commonly pivotable over 90° or at least 180° about the guide axis oriented parallel to planes 9, 10, 17, 19. Stop 31 can thus be transferred from the two stop positions into a resting position oriented vertically upwards in which it is located out of the way of the lifting path of both tables 23. Linearly adjusting and pivoting are mutually independently done with each stop by a drive 43. The only two stops 31 are also commonly and synchroneously shiftable in opposing directions. Thus layer 2 can be aligned by a gripper action with table top 18 stationary.

Stop 34 is continuously shiftable parallel to direction 12 by a guide 44 and a drive 45, for example a fluid cylinder. The piston rod therof is connected to a runner 46 of stop 34. Stop 34 is located spacedly below elements 44, 45. Pusher 35 is likewise linearly shiftable parallel to direction 12 by a corresponding guide and drive. Lower end of runner 48 supports pusher 35. Runner 48 freely protrudes downwards and is directly secured to the piston of fluid cylinder 47, i.e. without a piston rod. Runner 48 extends through a slot of the cylinder jacket thereby achieving stable guidance. Drive 47, like elements 44, 45, is also located at least in part or fully above elements 34, 35 or plane 10. Same applies to guide or mount 49 for stop 36 which is pivotably mounted over at least 90° or 180° about an axis parallel to direction 11. In stop position (FIGS. 4 and 5) stop 36 extends perpendicular to planes 9, 10, 17, 19 and in release position (FIG. 2) freely protrudes parallel to these planes in direction 12.

For feeding reams 3 in plane 10 a pile or feed conveyor 50 is provided which, like table 23 and all other conveyors, comprises an endless circulating transport element, namely two laterally tensioned pulling members 52, such as chains. At and between these chains supporting elements 51, for example equally sized plates, are secured in sequence with equal spacings in direction 12. Thus between adjacent layer or ream supports 51 a gap or opening 53 is formed through which ream 31 can be lowered onto table 23 and simultaneously swept from plate 51. The length of plates 51 or openings 53 parallel to direction 12 may be larger, smaller or the same in size as the same extension of reams 3. In addition, this extension of openings 53 may be larger, smaller or the same in size as the same extension of supports 51. With the upper run of conveyor 50 reams 3 are conveyed in plane 10 in direction 12 above table 23 until they run against stop 36 with their edge face 13. With continued motion of conveyor 50 each ream 3 is individually swept from its support 51 through the adjacent downstream opening 53. Thus ream 3 is deposited bit by bit in direction 12 in beginning with the lower edge of face 14 and up to edge face 13. Each support 51 carries only a single ream 3. The upper run of conveyor 50 uninterruptedly passes above both tables 23 and is guided downward at the remote sides of tables 23 on pulleys 54 to further pulleys. Between them the lower run returns below tables 23 and guide 27 with respect to stop 34. Stop 36 is always offset counter direction 12. Thus after deposition edge 13 is spaced from stop 34 even when stop 34 (FIG. 5) is set to its stop position on stop 39.

Frame 22 comprises a housing 55 in which tables 23, means 30, 40 and conveyor 50 are fully accomodated. The walls of housing 55 located directly adjacent to the ends of table tops 18 or of conveyor 50 form shields over the full height of apparatus 1 and are provided with openings 56 smaller than the associated wall to pass pallets 2, reams 3 and stack 4. Openings 56 for pallets 2 are located level with plane 9 and are provided in two opposite walls while being dimensioned sufficiently large, where necessary, to let the complete stack 4 conveyingly pass. Opening 56 for feeding reams 3 onto conveyor 50 is level with plane 10. Thereby one of pulleys 54 is provided directly adjacent to the inner side of the associated housing wall. Such openings may be provided level in both opposite walls, especially when each of the conveyors is drivable in the opposing directions.

The supporting parts of frame 22 are located totally within housing 55 and comprise side cheeks 57 oblong parallel to direction 12 and oriented at right angles to planes 9, 10, 17, 19. Cheeks 57 are provided on both sides in the vicinity of the ends of tables 23 and above these. Between cheeks 57 the upper run of conveyor 50 is located. At the inner sides of cheeks 57 and in plan view (FIG. 3) therebetween frame 22 comprises longitudinal beams 58 located on both sides of conveyor 50 parallel to direction 12. Beams 58 are rigidly connected to each other via cross-members 59 oriented parallel to direction 11. Frame 58, 59 formed thereby may be an interchangeable module which can be non-destructively released from side cheeks 57 or together therewith from remaining frame 22. This module can be continuously adjusted parallel to direction 11. Each station 20 or 21 may comprise one such separate module or this module may be provided in common for both stations 20, 21. To the upstream cross-member 59 aligning members 34, 36, 39 of station 20 may be mounted so that their effective alignment or stop faces are located below this cross-member 59. Correspondingly, the cited alignment members of station 21 are secured to the downstream cross-member 59. Guide and drive means 44, 45, 47 may also be provided on the cited module thus making it possible to simply adapt apparatus 1 to changes in format of layers 2, 3 whilst permitting good access for maintenance to all adjusting parts.

For feeding and discharging pallets 2 and reams 3 to and from each station 20 or 21 conveyor means 60 are provided outside of frame 22 or housing 55, these means being reversibly driveable to be suited for both feed and discharge conveyors. This applies to each of supply conveyors 61 to 64. Each conveyor 61 to 64 may be a belt conveyor including a driven conveyor belt running around pulleys and driveable with a motor independently of all other conveyors. With feed conveyors 61 in each case one pallet 2 is transferred in plane 9 directly to one of tables 23 in direction 11 through the associated opening 56. Parallel to direction 12 conveyor 61 can be motor-driven on a guide 65 of frame 22. Guide 65 is located below plane 9. In one guide position conveyor 61 is flush with each of tables 23 so that it can transfer pallet 2 optionally to any table 23. Upstream of conveyor 61 a preconveyor 62 is provided for transferring pallet 2 in plane 9 directly to conveyor 61 in direction 11. In plan view conveyor 62 is in line with table 23 of station 21. For receiving a pallet 2 conveyor 61 will be aligned along guide 65 in line with conveyor 62.

Feed conveyor 63 serves to directly transfer reams 3 in plane 10 and in direction 12 to conveyor 50 and connects conveyor 50 directly to the discharge of a packaging machine for reams 3. Therby at the opposite end of conveyor 50 too, such a feed conveyor 63 could be located with a conveying direction counter direction 12. A separately driveable discharge conveyor 64 for each table 23 connects to these ends of tables 23 which are remote from conveyor 61. Onto conveyor 64 a completed stack 4 is discharged in plane 9 and direction 11 from associated conveyor 24. By reversing the direction conveyors 64 may also transfer pallets to tables 23 and conveyors 61, 62 may transfer completed stacks 4 counter direction 11.

After pallet 2 has been aligned on table top 18, according to FIG. 4 reams 3 are deposited in a position offset with respect to the nominal alignment counter direction 12, namely by being swept off by stop 36. Thereby reams 3 may or may not protrude beyond the edge face 8 and their edge faces 14 or 13 may or may not be offset relative to each other. Whilst at the same time conveyor 50 continues to move and where necessary a further ream 3 has already run on stop 36, stop 34 above pallet 2 is travelled counter direction 12 against stop 39. At the same time pusher 35 above pallet 2 is travelled in direction 12 against edges 14 of reams 3. As a result and according to FIG. 5 pusher 35 aligns reams 3 in direction 12 in line with each other and centered relative to pallet 2 to achieve the nominal positioning. Thereby pusher 35 causes edges 13 to come in contact with stop 34 in a gripper action. During this alignment, depositing the next ream 3 on the stack can already commence, whereby its upstream edge may lay on pusher 35. During the continuing deposition of this next ream 3 pusher 35 is retracted counter direction 12 to its starting position at a speed higher than that in the pushing motion, namely in rapid travel, whilst stop 34 remains in contact with edge faces 13. After the next ream 3 was deposited prealigned by stop 36 or after table 23 was lowered by the height of a ream, this ream 3 too—as described—is transferred into the nominal position by aligning members 34, 35 as shown in FIG. 5. On lowering of table 23 edge faces areas 13 slide into contact with stop 34.

Reams 3 may be already precisely aligned in direction 11 on conveyor 63 or 50, e.g. by stationary inclined faces laterally sliding on edge faces 15, 16. Reams 3 running onto these sliding faces by the conveying force and are then shifted transversely. Alignment members 37, 38 show such inclined faces for station 21. Prior to, simultaneously with or following alignment in direction 12 reams 3, however, may also be aligned in direction 11 after having been deposited on table 23 by powered stops or pushers 37, 38. Thereby ream 3 are centered relative to pallet 2 by members 37, 38 being moved towards each other against edges 15, 16 in a gripper action. The level and height extension of members 37, 38 are expediently the same as those of members 34, 35 located level therewith.

After stack 4 has reached the desired or nominal stack height by being progressively lowered and piled and after thereby all layers 2, 3 have been aligned in the described way, stack 4 is lowered under members 34, 35, 37, 38 until plane 19 coincides with plane 9 and conveyor 24 transfers stack 4 through opening 56 to the associated conveyor 64. After final alignment of the topmost layer 3 on stack 4 also stop 34 is transferred into its starting or stop position retracted from stop 39. Then stop 34 is located in the same plane as stop 33 so that the next pallet 2 can be taken over in the described way.

Whilst in one station 20 a pallet 2 is fed, a stack of reams is piled or a palletted stack 4 is discharged, each of these works can simultaneously be done in the other station 21. By transferring stop 36 of station 20 alternatingly in the release and stop position a stack of reams can be piled simultaneously also with conveyor 50 in each station, e.g. by the reams 3 being alternatingly deposited in both stations 20, 21. Stop 36 is located in every position totally above plane 10 so that it does not need to be moved when all subsequent reams 3 of conveyor 50 are to be deposited in the same station 20 or 21.

All cited motion sequences, e.g. conveying, lifting and aligning sequences are controlled electronically by control means which signal the corresponding drives and where necessary are connected by signal lines to position detectors for the movable components of the apparatus or the layers 2, 3 of the stack. Thus results highly reliable and fully automatic operation. It will be appreciated that all stated properties and effects may be provided precisely or merely roughly or substantially as described and, depending on the properties of the material to be processed may also greatly depart therefrom. Pallets 2 may also be placed manually on conveyor 61 or 23. Apparatus 1 is suitable more particularly for relatively heavy stacks, the production and processing of which is more complicated than that of more lightweight stack layers, such as cartons, for instance. Supports 51 are stiffened or supported by suitable means so that they cannot sag under the weight of reams 3, they instead remaining planer between pulleys 54. They are, however, suitable to curve correspondingly in passing around pulleys 54. The length of each edge 13 to 16 may be more than one or two meters. The lowering height of each ream 3 from plane 10 onto the top of the stack amounts to maximally 10 cm or 6 cm, more particularly approximately 4 cm.

The control means may also comprise means for e.g. optically gauging the size of layers 2, 3 so that all drive means can be controlled in keeping with the results of measuring in such a way that the alignment means align each and every layer 2, 3 irrespective of its size precisely centered in the associated station 20 or 21. Conveyors 23, 50, 63, alignment members 31 to 39 and drive means 40 may be configured symmetrically to the middle plane oriented at right angles to planes 9, 10, 17, 19 and parallel to direction 12. Therefore two stops in each case being equal or having equal effects can be secured on both sides of this middle plane to the side cheeks 57 or the cross-bars 59. The stopping face of stop 34 may comprise inclined catch faces which, where necessary, come into contact with the edge portion belonging to edge 13 of the sinking ream 3 and allow it to slide with the ream 3 counter direction 12 toward pusher 35. For setting stops 34 or 36 or 39 of one or both stations 20, 21 units 58, 59 may also be positively adjustable by a motor parallel to direction 12. Each layer of the stack may also consists of a plurality of individual layers 3 juxtaposed in direction 11 and/or 12 which in a common plane are commonly fed and lowered from a support 51.

What is claimed is:

1. An apparatus for processing layers of substantially pressure-stiff material, each layer having edge faces transverse to each other and defining a layer plane, said apparatus comprising:

a base frame;

a stacking station on said base frame;

table means including at least one layer table, wherein said at least one layer table has a table face for receiving the layers, said table face positionable in a table plane in said stacking station;

wherein said at least one layer table is displaceable relative to said base frame in a lift direction oriented transverse to said table plane in said stacking station, said at least one layer table receiving said layers successively to form a stack of layers supported on said at least one layer table;

feed conveyor means for feeding layers to said table means, said feed conveyor means including support means circulating along an endless path;

aligning means for precisely and positively aligning the layers on said table face, said aligning means including a first aligning member and a second aligning member for engaging opposing edge faces of said layers; and wherein said first aligning member has a drive for positively and continuously pushing the layers along said table face in a first aligning direction, and said second aligning member has a drive for moving said second aligning member in a second aligning direction opposite to said first aligning direction to adjust the operational position of said second aligning member.

2. The apparatus according to claim 1, wherein:

said aligning means further comprises opposing stops for positioning the layers when the layers are received and supported on said table face, wherein said stops are linearly displaceable with respect to said table face in a second aligning direction oriented transverse to said first aligning direction and parallel to said table plane, and said table plane is continuously displaceable in said lift direction with respect to said stops;

the layers while being stacked define a stack having a height which varies synchronously with a height distance of said first and second aligning members from said table plane; and the apparatus further comprises a stop bearing for linearly and displaceably receiving said first and second aligning members, said stop bearing being stationary with respect to said base frame.

3. The apparatus according to claim 1, wherein:

the layers include a first layer and second layers superimposed on each other;

the first layer includes first edge faces and said second layers include second edge faces;

at least one of the second edge faces is parallel and laterally set back with respect to at least one of the first edge faces when the first layer and the second layers are superimposed to form a stack unit supported and aligned on said layer table;

said first and second aligning members abut against both the first and second edge faces to primarily position the first layer on said layer table and to subsequently position the second layers on the first layer with the at least one of the second edge faces laterally set back relative to the at least one of the first edge faces; and said drives for said first and second aligning members are motors, said first and second aligning members being thereby displaceable transverse to the first and second edge faces.

4. The apparatus according to claim 3, wherein:

the first layer is a pallet and the second layers are paper stacks smaller than the pallet;

a positioning stop positively abuts and engages said first aligning member when displaced transverse to and toward one of the second edge faces and when moving past one of the first edge faces over the pallet; and said second aligning member includes a pusher primarily forcing the pallet against said first aligning member while said first aligning member is spaced from said positioning stop, subsequently said pusher forcing at least one of the paper stacks against said first aligning member after said first aligning member has moved past one of the first edge faces over the pallet and when said first aligning member is abutted on said positioning stop.

5. The apparatus according to claim 3, wherein said first aligning member includes a sliding face for slidingly contacting the second edge faces while the second layers drop transverse to said table plane onto said table face, and wherein said second aligning member includes a pusher.

6. The apparatus according to claim 1, wherein:

said aligning means further includes a prealigning stop for prealigning the layers when vertically spaced above said table face;

said first and second aligning members are displaceable independently from said prealigning stop and realign the layers after the layers have descended below said prealigning stop onto said table face;

said prealigning stop and said first and second aligning members align the layers in said first aligning direction;

said prealigning stop aligns the layers in a feed plane and said first and second aligning members subsequently align the layers when the layers are descended from said feed plane to a stacking plane located below said feed plane;

said prealigning stop is permanently located entirely above said feed plane and said first and second aligning members are located entirely below said feed plane.

7. The apparatus according to claim 6, further comprising means for conveying and abutting the layers against said prealigning stop in said first aligning direction;

wherein said first aligning member includes a counterstop for abutting the layers when the layers are pushed against said first aligning member by said second aligning member, which is constituted by a pusher;

wherein said pusher opposes said counterstop and said prealigning stop, and is displaceable against said counterstop in said first aligning direction; and wherein said counterstop is displaced with respect to said prealigning stop in said first aligning direction.

8. The apparatus according to claim 7, wherein said aligning means further include a table stop displaceable with said layer table in said lift direction, and wherein said pusher aligns and displaces the layers alternatively against both said table stop and said first aligning member.

9. The apparatus according to claim 1, wherein said layer table includes a conveyor belt, wherein said conveyor belt defines said table face and is displaceable parallel to said table plane, and said conveyor belt is continuously displaceable in said lift direction with respect to said base frame; and wherein said aligning means include a table stop displaceable with said conveyor belt, said table stop being located laterally adjacent to said conveyor belt and projecting above said table plane.

10. The apparatus according to claim 1, wherein the layers include a lowermost support layer and stack layers piled onto the support layer to form the stack, said layer table being displaceable in said lift direction relative to said first and second aligning members for transferring said layer table into a first position, enabling the support layer to be aligned by said first and second aligning members with the support layer entirely supported on said table face; and wherein said layer table is in a second position lower than said first position, enabling the stack layers to be subsequently aligned with said first and second aligning members by sliding the stack layers on the support layer; and feed means for feeding the support layer onto said layer table in a first feeding plane and for feeding the stack layers in a second feeding plane, said second feeding plane permanently spaced above said first feeding plane and said table plane, said feed means including discharge means for entirely removing the stack from said apparatus.

11. The apparatus according to claim 1, wherein the feed conveyor means conveys the layers along a feed plane above said layer table, allows a layer to drop onto said layer table parallel to said lift direction, and performs a conveying motion parallel to said feed plane;

wherein said aligning means further includes a prealigning stop located above said feed plane for stopping motion of one of the layers during conveyance of said feed conveyor means beyond said prealigning stop and while the layer drops onto said layer table; and wherein, after the layers are entirely lowered and supported on said table face, said first and second aligning members align and slide the layers on said layer table, said first and second aligning members entirely positioned below said feed plane.

12. The apparatus according to claim 11, wherein said prealigning stop is entirely located above said feed plane, said first and second aligning members including aligning faces located entirely below said feed plane and suspended from above said feed plane, said feed conveyor means continuing said conveying motion in said first aligning direction while said second aligning member, constituted by a pusher, slides the layers on said layer table toward said first aligning member.

13. The apparatus according to claim 12, wherein:

said feed conveyor means comprises support plates for supporting the layers, and said feed conveyor means has interspaced passage gaps;

said feed conveyor means transversely drops the layers through said passage gaps onto said layer table while the layers rest against said prealigning stop;

said conveying motion is an exclusively unidirectional rotary motion, said feed plane and said table plane are parallel to each other and permanently superimposed; and said second aligning member slides the layers parallel to said conveying motion.

14. The apparatus according to claim 13, further comprising a second supply conveyor connected directly to said feed conveyor means for transferring the layers onto said feed conveyor means;

wherein, said feed conveyor means extends substantially across said layer table and directly receives the layers from said second supply conveyor above said table plane; and wherein said table face is displaceable parallel to said table plane for discharging the layers transverse to said conveying motion and said first aligning direction.

15. The apparatus according to claim 14, further comprising a first supply conveyor;

wherein the layers include first and second layers supported on said layer table;

wherein, on said table plane, said first supply conveyor directly transfers the first layer onto said table face transverse to said conveying motion and said second supply conveyor transfers the second layer onto the first layer;

wherein said first supply conveyor conveys transverse to said second supply conveyor and is permanently located below said second supply conveyor; and wherein said prealigning stop is located above said feed plane.

16. The apparatus according to claim 15, further comprising a housing;

wherein said feed conveyor means is located permanently above said layer table for receiving the second layer directly from said second supply conveyor;

wherein said housing envelopes said layer table, said feed conveyor means and said aligning members; and wherein at least one of said first and second supply conveyors are located outside said housing.

17. The apparatus according to claim 15, further comprising a table belt;

wherein said table belt defines said layer table for removing the first and second layers entirely from said layer table onto a discharge conveyor, said discharge conveyor conveying transverse to said first aligning direction;

wherein said table belt is located between said first supply conveyor and said discharge conveyor; and wherein said first supply conveyor, said table belt and said discharge conveyor convey the first and second layers transverse to said second supply conveyor and said feed conveyor means.

18. The apparatus according to claim 1, further comprising a feed conveyor means which has a feed plane and a conveying direction, support plates, and passage gaps between said support plates;

wherein said layer table includes first and second stacking tables separately displaceable in said lift direction and positioned adjacent one another in said first aligning direction;

wherein said feed conveyor means alternately drops the layers onto said first and said second stacking tables;

wherein said passage gaps allow passage of the layers through said feed conveyor means to drop said layers onto said first and second stacking tables, said support plates and passage gaps traveling in said conveying direction while said feed conveyor means continuously rotates; and wherein said support plates travel over said first stacking table above said first and second aligning members.

19. The apparatus according to claim 18, wherein said aligning means further includes a prealigning stop located above said feed conveyor means, said prealigning stop stopping the layers above said first stacking table when the layers are conveyed with said feed conveyor means;

said prealigning stop being displaceable to a first stop position to permit the layers to be conveyed from over said first stacking table to over said second stacking table; and said prealigning stop in a second stop position stopping the layers above said first stacking table.

20. The apparatus according to claim 1, wherein the layers include a first layer and paper stacks;

wherein said aligning means includes control means for initially depositing the first layer on said table face and for lifting said table face and the first layer, and then slidingly aligning the first layer on said table face in said first aligning direction;

wherein the paper stacks are prealigned one after the other above said table face in said first aligning direction, and are subsequently dropped one after the other onto the first layer to thereby form a stacked unit; and wherein the stacked unit is subsequently slidingly aligned on the first layer in said first and said second aligning directions prior to dropping a subsequent paper stack onto the stacked unit.

21. The apparatus according to claim 20, further comprising conveyor means for driving and displacing said layer table transverse to said lift direction and for continuously conveying the paper stacks substantially in and above said table plane;

wherein the first layer is a pallet larger than the paper stacks;

wherein said control means displace said table face in said lift direction after prealigning and depositing the pallet, and subsequently stop said table face;

wherein the pallet is aligned on said table face with said first and second aligning members while paper stacks are simultaneously conveyed one after the other above the pallet; and wherein the paper stacks are subsequently dropped one after the other onto the pallet and thereafter the stacked unit is aligned and slid on the pallet by said first and second aligning members.

* * * * *